US006962118B1

(12) United States Patent
Shimono

(10) Patent No.: US 6,962,118 B1
(45) Date of Patent: Nov. 8, 2005

(54) INCINERATOR

(75) Inventor: Masanobu Shimono, Kobe (JP)

(73) Assignee: S. Mac Co., Ltd., Hyogo (JP)

( * ) Notice: Subject to any disclaimer, the term of this patent is extended or adjusted under 35 U.S.C. 154(b) by 148 days.

(21) Appl. No.: 10/381,138

(22) PCT Filed: Sep. 21, 2000

(86) PCT No.: PCT/JP00/06481

§ 371 (c)(1),
(2), (4) Date: Mar. 21, 2003

(87) PCT Pub. No.: WO02/25171

PCT Pub. Date: Mar. 28, 2002

(51) Int. Cl.[7] ..... F23B 5/00; F23G 7/06

(52) U.S. Cl. ..... 110/310; 110/211; 110/214; 110/295; 110/303; 110/309

(58) Field of Search ..... 110/208, 209, 110/210, 211, 212, 213, 214, 248, 235, 291, 295, 297, 296, 303, 309, 310, 322, 346

(56) References Cited

U.S. PATENT DOCUMENTS 4,483,258 A * 11/1984 John et al. ..... 110/235
5,957,065 A * 9/1999 Hough et al. ..... 110/194

FOREIGN PATENT DOCUMENTS

| | | | | |
|---|---|---|---|---|
| FR | 2614393 A1 | * | 10/1988 | ..... F23G/5/16 |
| JP | 5-223226 A | | 8/1993 | |
| JP | 9-42635 A | | 2/1997 | |
| JP | 10-8064 A | | 1/1998 | |
| JP | 11-294745 A | | 10/1999 | |

* cited by examiner

*Primary Examiner*—Kenneth Rinehart
(74) *Attorney, Agent, or Firm*—Ronald E. Greigg

(57) ABSTRACT

An incinerator capable of fully preventing dioxins from being released, and has high fuel economy with less fuel consumption. The basic constitution of the incinerator is such that entire gas volume including unburned gas generated in a first combustion chamber (A) is temporarily collected in a gas collecting chamber (B), and the entire gas volume including unburned gas is introduced from the gas collecting chamber (B) into a second combustion chamber (C), while complete combustion is achieved by burning only the gas in the second combustion chamber (C).

12 Claims, 3 Drawing Sheets

INCINERATOR

CROSS-REFERENCE TO RELATED APPLICATION

This application is a 35 USC 371 application of PCT/JP00/06481 filed on Sep. 21, 2000.

BACKGROUND OF THE INVENTION

1. Field of the Invention

The present invention relates to an incinerator, and particularly to an incinerator that is capable of economically incinerating city garbage and industrial waste including high polymer waste such as plastics with low cost, and is capable of fully preventing dioxins from being generated.

2. Description of the Prior Art

Guideline for Preventing the Generation of Dioxins in Waste Processing, enacted in 1997 to regulate the processing of wastes in Japan, stipulates that permissible emission of dioxins is within 0.1 ng-TEQ/$Nm^3$ for newly built incinerators (full-continuous type). It is also stipulated that an incinerator must be operated under the following conditions: combustion temperature of 850° C. or higher (preferably 900° C. or higher), retention time of 2 seconds or longer, CO concentration of 30 ppm or lower and stable combustion under continuous monitoring.

To comply with the guideline described above, the present applicant filed Patent Application No. 10-126574 (Japanese Unexamined Patent Publication (Kokai) No. 11-294745) on Mar. 31, 1998.

The invention of Japanese Unexamined Patent Publication (Kokai) No. 11-294745 provides an intermediate baffle WI that is made of a refractory material and is included in a combustion chamber D of an incinerator, while unburned gas generated in the combustion chamber D is introduced into a recombustion chamber C and is burned at a high temperature therein, so that pollutants are thermally decomposed. Since the intermediate baffle WI terminates at a middle portion in the furnace and clear separation is not provided between the combustion chamber D and the recombustion chamber C, there has been such a problem that unburned gas that includes much CO generated in the combustion chamber D and ash content included in the unburned gas are discharged to the outside through the recombustion chamber C without being sufficiently burned in the recombustion chamber C. Release of the gas that includes CO may involve dioxins and has been a problem to be solved.

With this background, an object of the present invention is to provide an incinerator that can eliminate the drawbacks of the incinerators of the prior art and substantially prevent dioxins from being released, while requiring less fuel supply for higher economy.

SUMMARY OF THE INVENTION

An incinerator of the present invention, in order to achieve the object described above, has such a basic constitution as the entire volume of gas including unburned gas generated in a first combustion chamber is temporarily collected in a gas collecting chamber, while the entire gas including unburned gas is introduced from the gas collecting chamber surely into a second combustion chamber, and complete combustion is achieved by burning only the gas in the second combustion chamber.

Based on the fundamental concept described above, the incinerator of the present invention has the following features.

According to a first aspect of the present invention, the incinerator comprises at least a first combustion chamber A where waste charged therein is burned, a gas collecting chamber B where the entire gas volume including unburned gas generated in the first combustion chamber A is temporarily collected, a second combustion chamber C where the gas supplied from the gas collecting chamber B is introduced together with the auxiliary fuel gas and the combustion air, so as to be burned at a high temperature, and a reaction chamber D where the gas that has passed through the second combustion chamber C is retained therein for a required period of time before reaching an exhaust port 13 and, at the same time, ash included in the gas is caused to precipitate.

With the constitution described above, entire volume of the gas including unburned gas generated in the first combustion chamber A is once collected in the gas collecting chamber B. Then the gas collected in the gas collecting chamber B is introduced into the second combustion chamber C together with auxiliary fuel gas and combustion air. In the second combustion chamber C, only the gas without solid components is burned at a high temperature by means of combustion air, so that the unburned gas included in the gas is completely burned at a high temperature, thereby preventing dioxins from being generated. Flow of the gas that has passed through the second combustion chamber C is slowed and retained in the reaction chamber for a required period of time before being discharged to the outside through the exhaust port. Ash included in the gas is precipitated in the reaction chamber D.

According to a first aspect of the present invention, the incinerator is made in vertical construction wherein the vertical in-furnace space is divided by a partition wall 20 consisting of wall portions 21, 22, 23 and 24, with the first combustion chamber A and the gas collecting chamber B being installed in the in-furnace space below the partition wall 20 and the second combustion chamber C and the reaction chamber D located above are installed in the in-furnace space above the partition wall 20.

With this constitution, the combustion gas, unburned gas and other gas (including suspended solids such as the ash and dust floating in the gas) generated in the first combustion chamber A do not directly enter the second combustion chamber C. Since the vertical in-furnace space is divided by the partition wall (baffle) 20 with the first combustion chamber A and the gas collecting chamber B installed below the partition wall 20 while the second combustion chamber C and the reaction chamber D located above installed above the partition wall 20, the chambers A, B, C and D are arranged compactly in the form of vertical stack in the vertical in-furnace space, and the generated gas is smoothly guided from the bottom to the top of the vertical in-furnace space.

Also according to the first aspect of the incinerator of the present invention, the first combustion chamber A is made in such a construction that the partition wall 20 (21, 22) that constitutes the ceiling and the grate 30 in the floor are inclined to descend forward, so that waste charged through the charging port 12 that is provided amid the vertical incinerator is burned while moving down from the charging port 12 forward.

With this constitution, the waste charged into the first combustion chamber A is burned while moving down from the charging port 12 forward against the flow of the combustion gas. Therefore, in the first combustion chamber A, combustion temperatures can be made substantially uniform throughout the entire region from the charging port 12 to the lowest point of the first combustion chamber, thus making it possible to control the combustion temperatures with less variation in the first combustion chamber.

Also according to the first aspect of the incinerator of the present invention, the gas collecting chamber B is formed as a long chamber that continues upward from a space near the distal end of the first combustion chamber A, so as to temporarily accommodate the entire volume of gas including unburned gas generated in the first combustion chamber A.

With this constitution, it is made possible to restrict the height of the vertical furnace without much of the in-furnace space in the upper portion of the first combustion chamber A occupied by the gas collecting chamber B despite being a vertical chamber. Also because the entire gas generated in the first combustion chamber A is temporarily accommodated in the gas collecting chamber B, the entire volume of gas can be sent to the second combustion chamber C after being sufficiently conditioned in the gas collecting chamber B to be suitable for combustion. Thus combustion in the second combustion chamber C can be carried out satisfactorily.

Also according to the first aspect of the incinerator of the present invention, the second combustion chamber C is constituted by delimiting with the partition wall 20 (21, 22) in the ceiling of the first combustion chamber A and the partition wall 20 (23) that is the side wall of the gas collecting chamber B that continues thereto, so as to adjoin the gas collecting chamber B above the first combustion chamber A, while the gas collected in the gas collecting chamber B is introduced through the gas inlet port 40 that is formed in the partition wall 20 (23) that is the side wall of the gas collecting chamber B.

With this constitution, the first combustion chamber A, the gas collecting chamber B and the second combustion chamber C are disposed very compactly in the vertical furnace. Moreover, the gas that has moved from the first combustion chamber A into the gas collecting chamber B is introduced through the partition wall 20 (23) that is the side wall of the gas collecting chamber B into the second combustion chamber C, so as to be used in combustion. That is, any forcible way of introducing the gas such as flowing the gas downward is avoided and compact arrangement of the chambers A, B and C is achieved.

A second aspect of the incinerator of the present invention has such a construction in addition to the constitution of the first aspect, as the second combustion chamber C is separated from the reaction chamber D located above by means of air curtain that covers an opening 63 formed by narrowing the top opening of the second combustion chamber C.

According to the second aspect described above, in addition to the operation and effects of the first aspect, the gas that has been supplied from the gas collecting chamber B into the second combustion chamber C, the auxiliary fuel gas or combustion air is prevented from leaking into the reaction chamber D. This ensures complete combustion at a high temperature in the second combustion chamber C. Also in case any gas that is incompletely burned flows from the second combustion chamber C toward the reaction chamber D, the gas is burned by means of air supplied by the air curtain, the gas is prevented from entering the reaction chamber D in the state of incomplete combustion.

A third aspect of the incinerator of the present invention has such a construction in addition to the constitution of the first aspect, as the floor of the second combustion chamber C constituted from the partition wall 20 that separates the first combustion chamber A is inclined, and a clinker dropping hole 61 is provided in the bottom of the floor that allows clinker generated in the second combustion chamber C to fall therethrough into the first combustion chamber A.

According to the third aspect described above, in addition to the operation and effects of the first aspect, the molten material generated through combustion of the gas at high temperature in the second combustion chamber C is caused to drop through the clinker drop hole 61 formed in the partition wall 20 (22) into the first combustion chamber A, and can be discharged together with the incinerated material generated in the first combustion chamber A. Therefore, it becomes unnecessary to separately dispose of the incinerated materials generated in the first combustion chamber A and the second combustion chamber C.

Of course, the clinker drop hole 61 needs not be so large as to allow the gas generated in the first combustion chamber A to enter the second combustion chamber C through the clinker drop hole 61. If ever leakage occurs, the amount is small enough to have no substantial adverse influence.

A fourth aspect of the incinerator of the present invention has such a construction in addition to the constitution of the first aspect, as the gas collecting chamber B is provided with the combustion air supply port 50 for supplying air used in combustion in the second combustion chamber C, so as to mix the gas supplied from the first combustion chamber A and the combustion air in the gas collecting chamber B.

According to the fourth aspect described above, in addition to the operation and effects of the first aspect, the combustion air used in combustion in the second combustion chamber C is first introduced into the gas collecting chamber B, so that the gas supplied from the first combustion chamber A and the combustion air are mixed sufficiently in the gas collecting chamber B. Therefore, since the second combustion chamber C is supplied with the gas that has been sufficiently mixed with air and is ready for combustion, satisfactory combustion can be achieved.

A fifth aspect of the incinerator of the present invention has such a construction in addition to the constitution of the first aspect, as a nozzle 41*a* of the combustion assisting gas burner 41 is installed so as to face the gas inlet port 40 that introduces the gas from the gas collecting chamber B to the second combustion chamber C so that the gas held in the gas collecting chamber B is entrained by the auxiliary fuel gas that is discharged from the nozzle 41*a*, so as to mix therewith and enter the second combustion chamber C together.

According to the fifth aspect described above, in addition to the operation and effects of the first aspect, the gas held in the gas collecting chamber B is entrained by the ejector effect of the auxiliary fuel gas injected from the nozzle 41*a* of the combustion assisting gas burner 41 that faces the gas inlet port 40 which leads to the second combustion chamber C, so that both gases are mixed sufficiently and introduced together vigorously into the second combustion chamber C thereby to be burned in the second combustion chamber C. Therefore, satisfactory combustion can be achieved in the second combustion chamber C since well-mixed gas is burned, and vigorous combustion can be expected.

A sixth aspect of the incinerator of the present invention has such a construction in addition to the constitution of the first aspect, as the first combustion chamber A is made in such a constitution as the combustion air is supplied from below the grate 30 of the floor through the grate, with an ash discharge port 34 provided below the lower end of the inclined grate 30.

According to the sixth aspect described above, in addition to the operation and effects of the first aspect, the waste charged through the charging port 12 moves down toward the distal end of the grate 30 against the flow of the combustion gas while being burned by the combustion air supplied from below the grate 30. Much of the gas generated in the first combustion chamber flows from near the distal end of the grate 30 upward and enters the gas collecting chamber B. Incinerated material generated in the first combustion chamber A moves down the grate 30 forward, and falls off the distal end of the grate 30 toward the ash discharging portion. Thus the incinerated ash and gas are separated spontaneously while moving in the first combustion chamber A, so as to smoothly proceed to the next process.

A seventh aspect of the incinerator of the present invention has such a construction in addition to the constitution of the first aspect, as the gas duct 52 is provided for extracting the gas from the combustion space located at the top near the charging port 12 of the first combustion chamber A and supplying the gas into the gas collecting chamber B.

According to the seventh aspect described above, in addition to the operation and effects of the first aspect, the gas accumulated in the combustion space located at the top near the charging port 12 of the first combustion chamber A is easily extracted by means of the gas duct 52 and introduced into the gas collecting chamber B. Therefore, the entire volume of gas generated in the first combustion chamber A can be smoothly and surely introduced into the gas collecting chamber B without remaining in the combustion chamber.

An eighth aspect of the incinerator of the present invention has such a construction in addition to the constitution of the seventh aspect, as the gas in the gas duct 52 is introduced into the gas collecting chamber B along with the combustion air by negative pressure when introducing the combustion air used in the combustion in the second combustion chamber C into the gas collecting chamber.

According to the eighth aspect described above, in addition to the operation and effects of the seventh aspect, the gas extracted from the first combustion chamber A can be introduced into the gas collecting chamber B by the ejector effect that accompanies the introduction of the combustion air into the gas collecting chamber B, without providing such means as applying pressure particularly for the introduction.

A ninth aspect of the incinerator of the present invention has such a construction in addition to the constitution of the first aspect, as the waste is burned in the first combustion chamber A at a temperature below the melting point of the waste.

According to the ninth aspect described above, in addition to the operation and effects of the first aspect, the waste is prevented from being melted in the first combustion chamber A since the waste is burned in the first combustion chamber A at a temperature below the melting point of the waste, so that smooth movement of the waste can be ensured without obstructing the movement of waste by sticking onto the grate 30 or the like on the furnace floor. Also obstruction of the supply of combustion air from under the furnace floor can be prevented. Incineration ash generated through combustion in the first combustion chamber A is separated from the gas and remains on the grate of the combustion chamber floor as a solid, and is moved to an ash discharging section 34.

A tenth aspect of the incinerator of the present invention has such a feature in addition to the operation and effects of the first aspect, as combustion in the first combustion chamber A is carried out in the state of incomplete combustion due to shortage of oxygen.

According to the tenth aspect described above, in addition to the operation and effects of the first aspect, the waste that has been charged is subjected to dry distillation because of the incomplete combustion due to shortage of oxygen, thereby generating much unburned gas. The unburned gas is introduced via the gas collecting chamber B into the second combustion chamber C, and burned together with the auxiliary fuel gas. Since the unburned gas includes a high CO content, the combustion can be carried out while substantially saving the auxiliary fuel gas.

An eleventh aspect of the incinerator of the present invention has such a feature in addition to the operation and effects of the first aspect, that combustion in the second combustion chamber C is carried out at a high temperature of at least 1100° C.

According to the eleventh aspect described above, in addition to the operation and effects of the first aspect, since the gas that has been generated in the first combustion chamber A and introduced via the gas collecting chamber B into the second combustion chamber C and includes the unburned gas is burned at a high temperature of at least 1100° C. together with the auxiliary fuel gas and the combustion gas in the second combustion chamber C, generation of dioxins can be completely prevented. CO gas included in the unburned gas is completely burned so as to turn into $CO_2$. Therefore, exhaust gas completely free of CO can be emitted. Also burning at 1100° C. or higher causes the ash floating in the second combustion chamber C to melt and drop onto the floor. Since $CO_2$ may be reduced into CO when the burning temperature is too high, the burning temperature is preferably below the temperature at which reduction of $CO_2$ into CO begins (for example, 1200° C.).

BRIEF DESCRIPTION OF THE DRAWINGS

The foregoing features and advantages of the invention will become more apparent from the detailed description contained herein below, taken in conjunction with the drawings, in which.

DESCRIPTION OF THE PREFERRED EMBODIMENTS

An example of a preferred incinerator according to the present invention will be described below with reference to FIG. 1 to FIG. 3.

Figure 1:
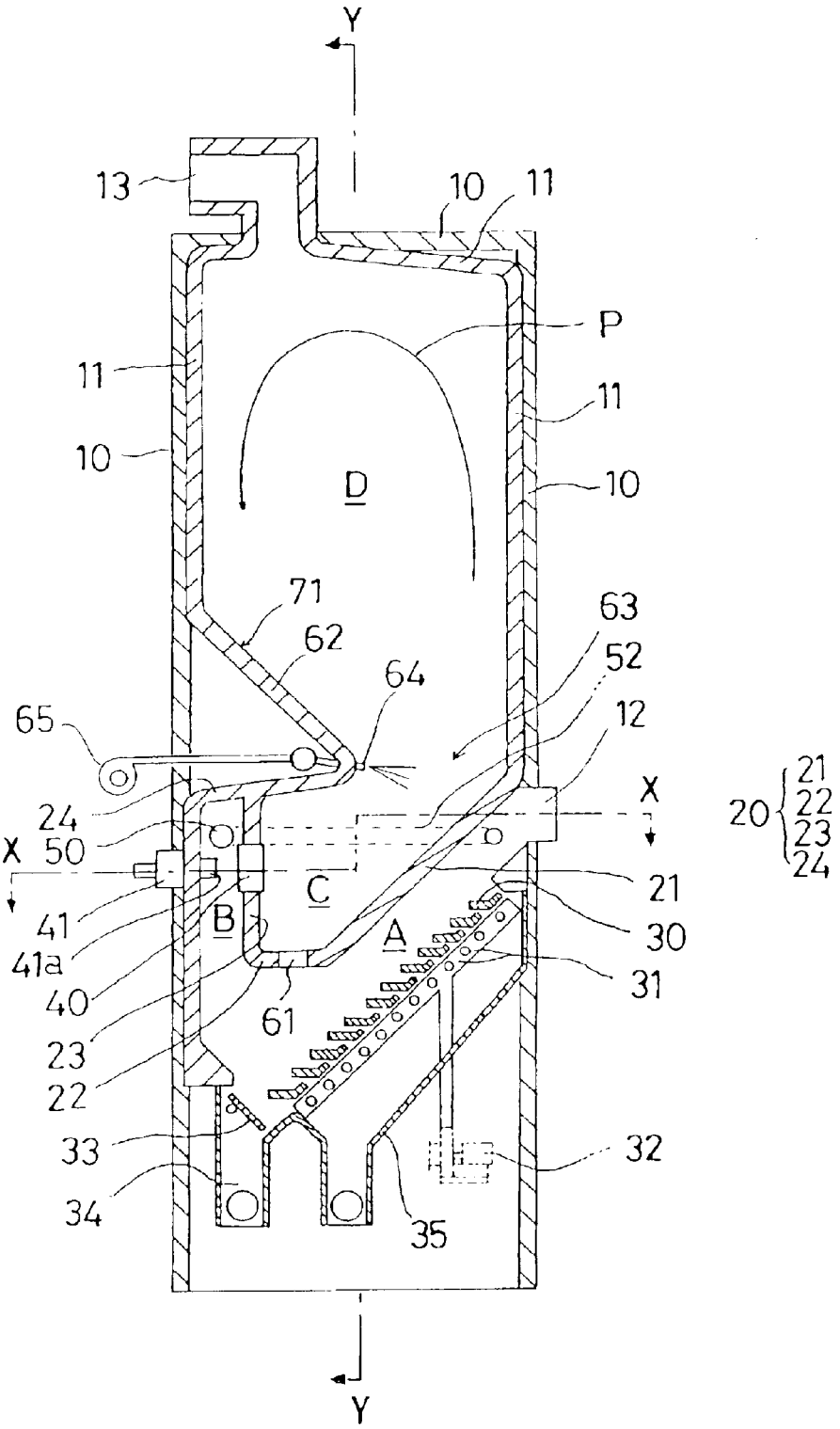
FIG. 1 is a longitudinal sectional view of a preferred incinerator according to the present invention.
Figure 2:
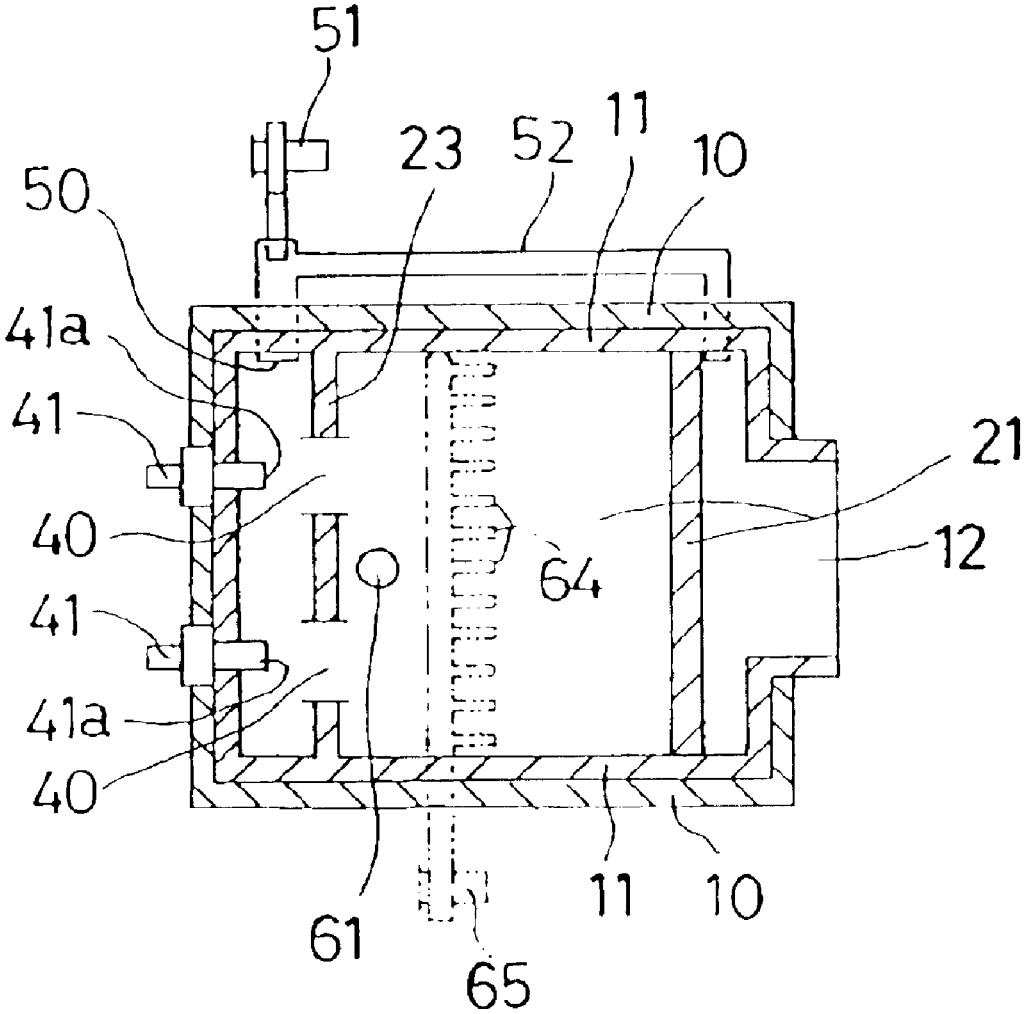
FIG. 2 is a sectional view taken along lines X—X of FIG. 1.
Figure 3:
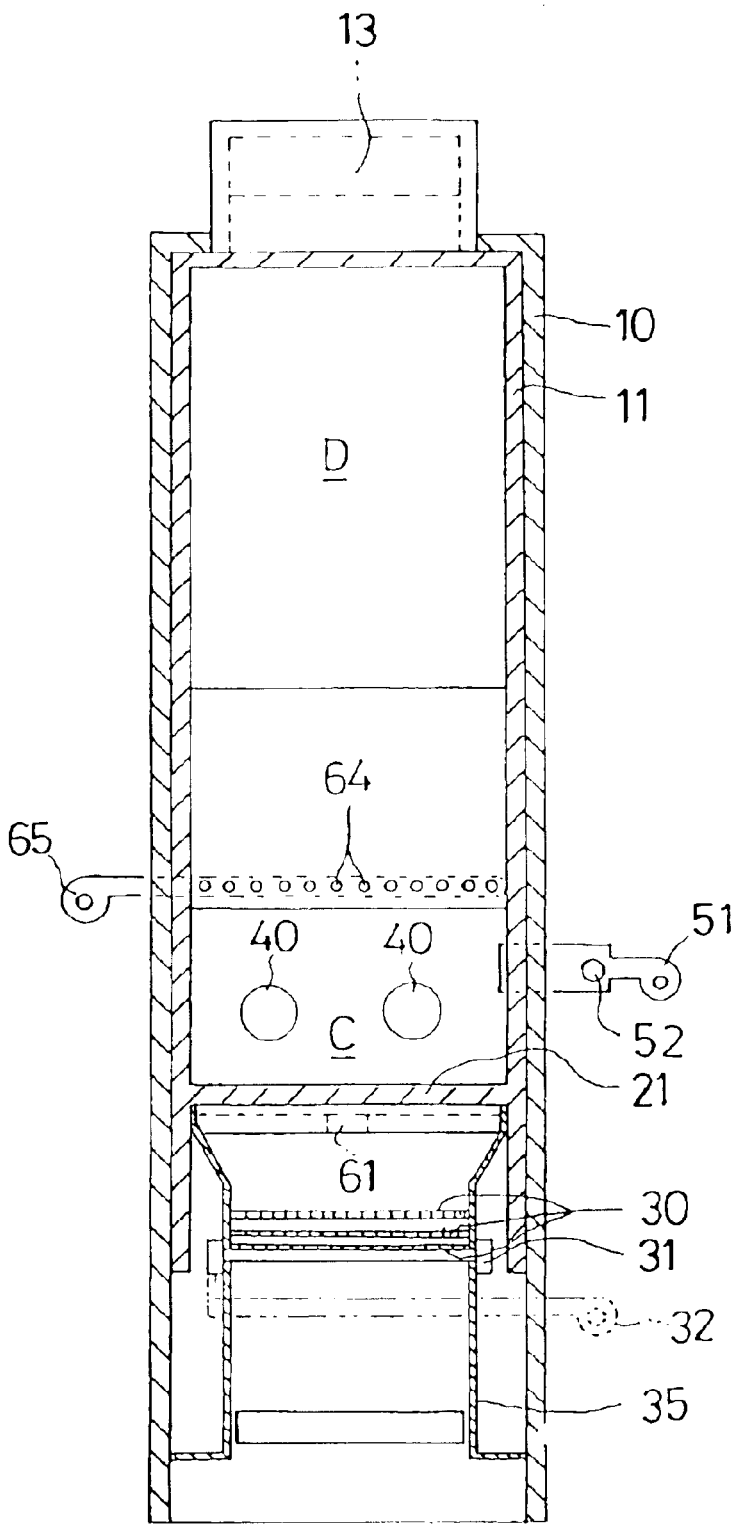
FIG. 3 is a sectional view taken along lines Y—Y of FIG. 1

The incinerator shown in FIG. 1 to FIG. 3 is made in vertical construction. The furnace comprises an outer wall 10 that forms at least four side surfaces and top surface thereof. Portions that face the furnace space where the temperature becomes very high are provided with a lining 11 made of a refractory material on the inner surface of the outer wall 10. Reference numeral 12 denotes a waste charging port, and 13 denotes an exhaust port.

The space within the furnace is divided into upper and lower portions by a partition wall 20, consisting of wall portions 21, 22, 23 and 24.

A first combustion chamber A and a gas collaring chamber B are provided below the partition wall 20. A second combustion chamber C and a reaction chamber D are provided above the partition wall 20.

The first combustion chamber A is inclined so as to descend from the charging port 12 forward. Accordingly, the ceiling and a grate 30 of the floor of the first combustion chamber A are inclined. The ceiling of the first combustion chamber A is constituted from the inclined wall 21 portion of the partition wall 20.

The grate 30 is constituted from a plurality of small grates that can rotate by a predetermined angle, so that the waste that has been charged through the charging port 12 moves forward downward by gravity.

A combustion air supply section 31 is installed on the back of the grate 30, so that combustion air supplied from the combustion air supplying means 32 is introduced from the combustion air supply section 31 through the opening of the grate 30 into the first combustion chamber A.

Installed below the distal end of the grate 30 (lowest position at the end of waste movement) is an ash discharging portion 34 via a damper 33. Reference numeral 35 denotes an ash receiving pan.

The gas collecting chamber B is formed as a long chamber above combustion chamber A, and is located above and continues to a combustion space near the distal end of the grate 30 of the first combustion chamber A. The inclined wall portion 21 of the partition wall 20 that constitutes the ceiling of the first combustion chamber A continues, at the distal end (lowest portion) thereof, to a short and low wall portion 22 and to a vertical wall portion 23, thereby constituting the side wall of the gas collecting chamber B. The ceiling of the gas collecting chamber B continues to a high wall portion 24 that continues to the vertical wall portion 23 of the partition wall 20.

The gas collecting chamber B adjoins with the second combustion chamber C via the vertical wall portion 23 of the partition wall 20. The vertical wall portion 23 of the partition wall 20 has a gas inlet port 40 formed therein for introducing the gas held in the gas collecting chamber B into the second combustion chamber C. In this example, two gas inlet ports 40 are provided at a distance from each other in horizontal direction. Disposed to face the two gas inlet ports 40 are nozzles 41*a*, 41*a* of combustion assisting gas burners 41, 41 installed on the gas collecting chamber B side. Auxiliary fuel gas discharged from the nozzle 41*a* of the combustion assisting gas burner 41 passes through the gas inlet port 40 and enters the second combustion chamber C, while entraining the gas held in the gas collecting chamber B by ejector effect, so as to mix therewith and enter the second combustion chamber C together.

The gas collecting chamber B has a combustion air supply port 50 for supplying air used in combustion in the second combustion chamber C. The supply port 50 is provided so as to penetrate the walls 10, 11 that are at right angles with the vertical wall portion 23 wherein the gas inlet port 40 is provided. Air supplied from the combustion air supplying means 51 through the supply port 50 enters the gas collecting chamber B, and is mixed with the gas supplied from the first combustion chamber A.

The gas collecting chamber B has a gas duct 52 connected thereto for extracting the gas from the combustion space located at the top near the charging port 12 of the first combustion chamber A and sending the gas into the gas collecting chamber B. A joint for connecting the gas duct 52 to the gas collecting chamber B also serves for the combustion air supply port 50. With such a constitution as air from the combustion air supplying means 51 is injected into the gas duct 52 located immediately before the supply port 50, gas extracted from the first combustion chamber A is drawn by suction through the gas duct 52 by the air, so as to enter the gas collecting chamber B together.

The second combustion chamber C is separated from the first combustion chamber A by the inclined wall portion 21 and the low wall portion 22 of the partition wall 20, and is separated from the gas collecting chamber B by the vertical wall portion 23 of the partition wall 20.

The floor of the second combustion chamber C is constituted from the inclined wall portion 21 and the low wall portion 22, and molten material (clinker) generated in the second combustion chamber C flows toward the low wall portion 22 along the inclined wall portion 21. A clinker drop hole 61 is formed in the low wall portion 21. The clinker drop hole 61 is made to such a size that the clinker can easily drop therethrough but is not so large as to allow the gas generated in the first combustion chamber A to enter the second combustion chamber C through the clinker drop hole 61. If ever gas from Chamber A enters the second combustion chamber C, the amount is small enough to have no substantial adverse influence.

The clinker drop hole 61 is preferably located near the distal end of the grate 30 of the first combustion chamber A. The clinker that has dropped through the clinker drop hole 61 solidifies in the first combustion chamber A and falls near the distal end of the grate 30, so as to join the ash in the first combustion chamber A and moves toward the ash discharging portion 34.

Upper portion of the second combustion chamber C constitutes a protruding portion 62 that is formed by bending a part of the inner wall 11 so as to protrude above the gas inlet 40, so that the area of the upper opening 63 is made smaller by means of the protruding portion 62. The protruding portion 62 has a plurality of air outlet holes 64 formed in the horizontal direction at the distal end thereof, so that air supplied by the air supply means 65 is blown to the upper opening 63 thereby forming an air curtain. The air curtain isolates the second combustion chamber C from the reaction chamber D located above.

The reaction chamber D is a relatively large space located above the second combustion chamber C. The gas that has exited the second combustion chamber C and entered the reaction chamber D lowers the speed thereof and flows as indicated by arrow P by convection, and eventually reaches the exhaust port 13 to be discharged therefrom. A proper retention time before reaching the exhaust port 13 is ensured for the gas in the reaction chamber D.

By forming the top surface of the protruding portion 62 in an inclined portion 71, the ash content that has been precipitated from the gas staying in the reaction chamber D falls on the inclined portion 71 and then drops in the second combustion chamber.

Now the operation will be described below for the incinerator of the present invention having the constitution described above.

As waste is charged continuously through the charging port 12, and combustion air is supplied from the combustion air supplying means 32 through the combustion air supply section 31 and the opening of the grate 30 into the first combustion chamber A, combustion in the first combustion chamber A is started by ignition means not shown. The waste is burned while moving down on the grate 30 from the upper portion to the lower portion thereof. Since the combustion gas flows from the bottom obliquely upward in the combustion space of the first combustion chamber A, the waste moves against the flow of the combustion gas. Thus because of the relation between the moving direction of the waste and the flow direction of the combustion gas; combustion temperatures can be made substantially uniform throughout the entire region from the charging port 12 to the lowest point of the first combustion chamber A, thus making it possible to control the combustion temperatures with less variation in the first combustion chamber A.

Gas including unburned gas generated in the first combustion chamber A is collected from the distal end (end of movement of the waste) of the first combustion chamber A into the gas collecting chamber B. Gas accumulated in the combustion space located at the top near the charging port 12 of the first combustion chamber A flows through the gas duct 52 and is collected in the gas collecting chamber B. Thus all the gases generated in the first combustion chamber A are collected in the gas collecting chamber B.

Combustion in the first combustion chamber A is preferably carried out at a temperature below the melting point of the waste. The waste is prevented from being melted in the first combustion chamber A by burning at a temperature below its melting point, so that smooth movement of the waste can be ensured without obstruction by sticking onto the grate or the like on the furnace floor. Also obstruction of the supply of combustion air from under the furnace floor due to loading of the openings of the grate 30 can be prevented. Incineration ash generated through combustion in the first combustion chamber A is separated from the gas as a solid, and can be moved to the distal end of the grate 30 and into the ash discharging section 34.

The first combustion chamber A is preferably operated in the state of incomplete combustion. Incomplete combustion in the first combustion chamber A can be achieved by reducing the air supply from the combustion air supplying means 32, thereby generating much CO gas. Since the gas including much CO gas serves as a fuel, supply of auxiliary fuel gas for combustion in the second combustion chamber C can be reduced thereby cutting down on the operation cost.

Combustion in the first combustion chamber A is preferably carried out by controlling the temperature in the combustion space near the charging port 12 lower than the ignition temperature of CO gas (about 680° C.), for example below 650° C. Gas including a high concentration of CO can be generated by carrying out combustion at a temperature below the ignition temperature of CO gas. When combustion throughout the first combustion chamber A is carried out at a temperature below the ignition temperature of CO gas in the entire region of the first combustion chamber A, however, burning rate of the waste becomes slower, leading to longer time required for incineration. Therefore, combustion near the distal end (outlet side) in the first combustion chamber A is carried out by controlling the temperature higher than the temperature near the charging port 12, for example from 800 to 950° C., at a temperature below the melting point of the waste so as to achieve a sufficiently high efficiency of combustion.

The temperature control described above can be carried out by regulating the flow rate of air supplied from the combustion air supplying means 32 in accordance to the temperature measured by a temperature detector, or by means of control means not shown in the drawing that regulates the quantity of waste charged.

In the first combustion chamber A, as described above, the waste is subjected to dry distillation, so that much unburned gas and non-molten incineration ash are generated. The incineration ash is carried toward the distal end of the grate 30 and falls into the ash discharging portion 34.

The gas including unburned gas generated in the first combustion chamber A moves from the combustion space near the distal end of the first combustion chamber A into the gas collecting chamber B, and moves through the combustion space located at the top near the charging port 12 of the first combustion chamber A and through the gas duct 52 so as to enter the gas collecting chamber B. Accordingly, all the gas generated in the first combustion chamber A is collected in the gas collecting chamber B.

The gas collecting chamber B is supplied with combustion air used for combustion in the second combustion chamber C injected by the combustion air supplying means 51 through the gas inlet port 40. The gas that has been sent from the first combustion chamber A into the gas duct 52 is drawn by negative pressure generated by the ejector effect of the air blow from the combustion air supplying means 51, so that the air and gas are mixed and supplied into the gas collecting chamber B. Therefore, the gas extracted from the first combustion chamber A into the gas duct 52 can be introduced into the gas collecting chamber B smoothly, without providing such means as applying a pressure dedicated for the introduction of the gas. The gas from the first combustion chamber A and the combustion air are fully mixed in the gas collecting chamber B.

Injected from the gas collecting chamber B through the gas inlet port 40 into the second combustion chamber C are the gas sent from the first combustion chamber A into the gas collecting chamber B, the air sent from the combustion air supplying means 51 into the gas collecting chamber B and the auxiliary fuel gas supplied from the combustion assisting gas burner 41. The gas supplied from the gas collecting chamber B is entrained by the ejector effect of the auxiliary fuel gas spouted from the nozzle 41*a* disposed to face the gas inlet port 40 into the second combustion chamber C, so that the gas is mixed with the auxiliary fuel gas and introduced together into the second combustion chamber C. Therefore, satisfactory combustion can be achieved in the second combustion chamber C.

Complete combustion is achieved in the second combustion chamber C with the gas that has been introduced.

Complete combustion of the gas that has been introduced is achieved in the second combustion chamber C at a temperature high enough to prevent the generation of dioxins under the presence of sufficient supply of the combustion air.

Combustion in the second combustion chamber C is carried out preferably at a high temperature of 1100° C. or higher, for example by controlling the temperature in a range from 1100 to 1200° C. By carrying out complete combustion at such a high temperature, CO gas can be completely burned into $CO_2$, thereby minimizing the emission of CO gas and preventing the generation of dioxins. The temperature control is carried out by means of a temperature detector not shown in the drawing that measures the temperature in the second combustion chamber C and control means not shown in he drawing that controls the supply of combustion air and the supply of the auxiliary fuel in accordance to the measured temperature.

Ash content floating in the second combustion chamber C is melted and falls on the floor. The molten ash that has dropped flows over the inclined wall portion 21 of the partition wall 20 toward the low wall portion 22, and drops through the clinker drop hole 61 to the distal end side of the first combustion chamber A, where it solidifies and is discharged together with the incinerated material generated in the first combustion chamber A.

Since the top of the second combustion chamber C is narrowed by the protruding portion 62 to have smaller upper opening area 63, while the upper opening 63 is separated from the reaction chamber D located above by the air curtain formed by air blown from a plurality of air outlets 64, the gas held in the second combustion chamber C is prevented from leaking into the reaction chamber D, thus enabling combustion under a high load. Also in case the gas that is incompletely burned flows toward the reaction chamber D, the gas is burned by means of air supplied by the air curtain, so that the gas is prevented from entering the reaction chamber D while being incompletely burned.

The gas that has entered the reaction chamber D flows in the large chamber as indicated by arrow P while decreasing the speed, so that the ash carried therein precipitates. The gas is eventually exhausted from the exhaust port 13. Capacity of the reaction chamber D is set so that retention time of the gas therein is, for example, 2 seconds or longer, in accordance to the guideline for the prevention of dioxin emission. The ash content that has been precipitated moves down along the inclined portion 71 formed on the top surface of the protruding portion 62, so as to return into the second combustion chamber C where it is melted again and drops into the first combustion chamber A before being discharged through the ash discharging portion 34.

As described above, the incinerator according to the present invention is capable of substantially preventing dioxins from being released, and has a high value of utility as an economical incinerator that requires less fuel consumption.

The foregoing relates to preferred exemplary embodiments of the invention, it being understood that other variants and embodiments thereof are possible within the spirit and scope of the invention, the latter being defined by the claims.

I claim:

1. An incinerator comprising a charging port 12 a first combustion chamber A where waste charged therein is burned, a gas collecting chamber B where gas including unburned gas generated in said first combustion chamber A is temporarily collected, a second combustion chamber C where the gas from the gas collecting chamber B is introduced together with auxiliary fuel gas and combustion air and burned at a high temperature, a reaction chamber D where the gas that has passed through said second combustion chamber C is retained therein for a required period of time before reaching an exhaust port 13 and wherein ash included in the gas is caused to precipitate, said incinerator being made in vertical construction with the vertical in-furnace space being divide by a partition wall 20, said first combustion chamber A and said gas collecting chamber B in the furnace being located in the space below said partition wall 20 and the second combustion chamber C and said reaction chamber D being located above in the furnace space above the partition wall 20;

said first combustion chamber A having a floor including a grate 30, with a portion of the partition 20 (21, 22)

that constitutes a ceiling and the grate 30 in the floor being inclined to descend forward whereby waste charged through the charging port 12 into the vertical incinerator is burned while moving down from the charging port 12 forward;

said gas collecting chamber B being formed as a long chamber that continues upward from a space near the distal end of said first combustion chamber A, so as to temporarily accommodate the entire gas volume including unburned gas generated in the first combustion chamber A; and said second combustion chamber C being constituted by delimiting with the partition wall 20 (21, 22) in the ceiling of said first combustion chamber A and the partition wall 20 (23) that is a side wall of said gas collecting chamber B that continues thereto, so as to adjoin said gas collecting chamber B is introduced through a gas inlet port 40 that is formed in the partition wall 20 (23) that is the side wall of said gas collecting chamber B, and wherein the second combustion chamber C has a top portion narrowed to provide a top opening area 63, and means providing an air curtain separating the narrow top opening 63 from the reaction chamber D located above by the air curtain.

2. The incinerator according to claim 1, wherein floor of said second combustion chamber C constituted from the partition wall 20 and separating Chamber C from said first combustion chamber A is inclined, the incinerator further comprising a clinker dropping hole means in a bottom of the floor that allows clinker generated in the second combustion chamber to fall therethrough into the first combustion chamber.

3. The incinerator according to claim 1, wherein the gas collecting chamber B with further comprises a combustion air supplying means 50 for supplying air used in combustion in the second combustion chamber C, so as to mix the gas supplied from the first combustion chamber A and said combustion air in the gas collecting chamber A.

4. The incinerator according to claim 1, further comprising a nozzle 41*a* of a combustion assisting the gas burner 41 disposed to oppose the gas inlet 40 from the gas collecting chamber B to the second combustion chamber C, so that the gas supplied from the gas collecting chamber B is entrained by the auxiliary fuel gas spouted from the nozzle 41*a* so as to form a mixed gas that is introduced into the second combustion chamber C.

5. The incinerator according to claim 1, wherein the first combustion chamber A is made in such a constitution as the combustion air is supplied from below the grate 30 of the floor through the grate, with an ash discharge port 34 provided below the lower end of the inclined grate 30, and the gas collecting chamber B is provided above the combustion space near the distal end of the grate in continuation therewith.

6. The incinerator according to claim 1, further comprising a gas duct 52 for extracting gas from the combustion space located at the top near the charging port 12 of the first combustion chamber A and supplying the extracted gas into the gas collecting chamber B.

7. The incinerator according to claim 6, wherein extracted gas in the gas duct 52 is introduced into the gas collecting chamber B by negative pressure along with the combustion air when introducing the combustion air used in the combustion in the second combustion chamber C into the gas collecting chamber B.

8. The incinerator according to claim 1, wherein combustion in the first combustion chamber A is carried out at a temperature below the melting point of the waste.

9. The incinerator according to claim 1, wherein combustion in the first combustion chamber A is carried out in the state of incomplete combustion due to shortage of oxygen.

10. The incinerator according to claim 1, wherein combustion in the first combustion chamber A is carried out at a temperature below above 680° C.

11. The incinerator according to claim 10, wherein combustion in the second combustion Chamber C is carried out at a high temperature of at least about 1100° C.

12. The incinerator according to claim 1, wherein combustion in the second combustion Chamber C is carried out at a high temperature of at least about 1100° C.

* * * * *